US006600445B2

(12) United States Patent
Li

(10) Patent No.: US 6,600,445 B2
(45) Date of Patent: Jul. 29, 2003

(54) METHOD AND DEVICE FOR CALIBRATING SMART ANTENNA ARRAY

(75) Inventor: Shihe Li, Beijing (CN)

(73) Assignee: China Academy of Telecommunications Technology, Beijing (CN)

( * ) Notice: Subject to any disclaimer, the term of this patent is extended or adjusted under 35 U.S.C. 154(b) by 0 days.

(21) Appl. No.: 10/073,566

(22) Filed: Feb. 11, 2002

(65) Prior Publication Data

US 2002/0089447 A1 Jul. 11, 2002

Related U.S. Application Data

(63) Continuation of application No. PCT/CN00/00178, filed on Jun. 26, 2000.

(30) Foreign Application Priority Data

Aug. 10, 1999 (CN) ..... 99111350

(51) Int. Cl.[7] ..... H01Q 3/22
(52) U.S. Cl. ..... 342/368; 342/174
(58) Field of Search ..... 342/165, 174, 342/368, 365

(56) References Cited

U.S. PATENT DOCUMENTS 5,546,090 A 8/1996 Roy, III et al.

FOREIGN PATENT DOCUMENTS

| | | |
|---|---|---|
| EP | 0 415 574 A2 | 3/1991 |
| WO | WO 95/34103 | 12/1995 |
| WO | WO 97/44920 | 11/1997 |

*Primary Examiner*—Dao Phan
(74) *Attorney, Agent, or Firm*—Alston & Bird LLP

(57) ABSTRACT

This invention discloses a method and a device for calibrating smart antenna arrays in real time. The invention includes the steps of providing a calibrating link comprising a coupling structure, feeder cables and pilot transceiver; pre-calibrating the coupling structure with a vector network analyzer and recording its receiving and transmitting transmission coefficients, respectively; implementing the receiving calibration to a smart antenna array by adjusting the transmission coefficient of each receiving link and a reference link to the same amplitude and phase difference Φ, which is recorded and stored in a baseband processor; and implementing the transmitting calibration by adjusting the transmission coefficient of each transmitting link and a reference link to the same amplitude and phase difference Ψ, which is recorded and stored in the baseband processor. The coupling structure of the invention is implemented by a pilot antenna using spatial couple mode or a passive network.

14 Claims, 5 Drawing Sheets

METHOD AND DEVICE FOR CALIBRATING SMART ANTENNA ARRAY

CROSS REFERENCE TO RELATED APPLICATIONS

This is a continuation application of China Patent Application Number 99111350.0, filed Aug. 10, 1999, which is incorporated herein by reference in its entirety.

This is a continuation application of PCT/CN00/00178, filed Jun. 26, 2000, which is incorporated herein by reference in its entirety.

FIELD OF THE TECHNOLOGY

The present invention relates generally to smart antenna technology for wireless communication systems, and more particularly to a method for calibrating smart antenna arrays, as well as to a device for calibrating smart antenna arrays.

BACKGROUND OF THE INVENTION

In modern wireless communication systems, especially in CDMA wireless communication systems, smart antennas are generally used to increase system capacity, system sensitivity and communication distance with lower emission power.

The Chinese patent named "Time Division Duplex Synchronous Code Division Multiple Access Wireless Communication System with Smart Antenna" (CN 97 1 04039.7) discloses a base station structure for a wireless communication system with a smart antenna. The base station includes an antenna array consisting of one or more antenna units, corresponding radio frequency feeder cables and a set of coherent radio frequency transceivers. Each antenna unit receives signals from user terminals. The antenna units direct the space characteristic vectors and directions of arrival (DOA) of the signals to a baseband processor. The processor then implements receiving antenna beam forming using a corresponding algorithm. Among them, any one of the antenna unit, corresponding feeder cable and coherent radio frequency transceiver together is called a link. By using weight getting from the up link receiving beam forming of each link in the down link transmitting beam forming, the entire functionality of smart antennas can be implemented, under symmetrical radio wave propagation conditions.

In the above Chinese patent, for the smart antenna to combine receive and transmit beam accurately, the difference between each antenna unit of the smart antenna array, radio frequency feeder cable and radio frequency transceiver, should be known, i.e. the difference of amplitude and phase variation after the radio frequency signal passes each link should be known. A procedure for determining the difference among links of the smart antenna system is just one concern addressed by the smart antenna calibration of the invention.

Calibration of a smart antenna array is a kernel technology of smart antenna. A characteristic of electronic elements, which comprise radio frequency systems of smart antennas, especially active elements, is sensitivity to working frequency, environment temperature and working duration etc. Characteristics for each link, as a result of such variation, are typically never the same, thus requiring constant calibration of smart antenna systems.

At present, there are generally two kinds of calibration methods for smart antennas. One is a direct measure method. This method measures every set of radio frequency transceivers to obtain data related to its amplitude and phase.

Then the measured amplitude and phase characteristics of the antenna units and feeder cables are added to form a set of calibration data. This calibration procedure is very complicated. It is difficult to obtain all measurements in the field, especially for wireless communication systems that are in operation. Another method is to calibrate the system using a pilot transceiver at an antenna far-field region. This method requires the pilot transceiver to be located at a far-field region without multipath propagation. This, however, is also difficult to implement in practice.

SUMMARY OF THE INVENTION

Therefore, an object of the invention is to provide a method and device for calibrating smart antenna arrays in real-time, so as to render the use of smart antenna systems practicable. The device of the invention allows the method of the invention to work effectively.

A further object of the invention is to provide two designs and calibration methods of couple structures for calibrating smart antenna arrays, which also allows the method of the invention to work effectively.

A method of the invention for calibrating a smart antenna array comprises:

1) providing a calibration link with a coupling structure, a feeder cable and a pilot transceiver, wherein the coupling structure is coupled with N antenna units of the smart antenna array and the pilot transceiver is connected to a baseband processor of a base station by a digital bus;
2) calibrating the coupling structure with a vector network analyzer before the smart antenna array is put into operation, and recording its receiving transmission coefficient and transmitting transmission coefficient, respectively;
3) calibrating receiving of the smart antenna array by: transmitting a defined voltage level signal at a set working carrier frequency by an analog transmitter of the pilot transceiver, and setting N receiving links, in a base station to be calibrated, in a receiving state; detecting the output of each receiving link, respectively, by the baseband processor in the base station and calculating the ratio of the transmission coefficient of each link to the transmission coefficient of a reference link during receiving, according to the output of each receiving link; controlling the output of each receiving link by controlling a variable gain amplifier in an analog receiver present in each link r, so that the amplitude ratio of the receiving transmission coefficient of each link to the transmission coefficient of the reference link equals to 1; and recording and storing the phase difference $\Phi$ between each receiving link and the reference link in the baseband processor; and
4) calibrating transmitting of the smart antenna array by: setting one link in a transmitting state at one time while all other transmitting links of the N transmitting links are in a closing state, and receiving signals coming from each transmitting link, respectively, at a set working carrier frequency with an analog receiver, in the pilot transceiver; processing the signals by the baseband processor of the base station and calculating the ratio of the transmission coefficient of each link to the transmission coefficient of a reference link during transmission; controlling the output of each transmitting link by controlling a variable gain amplifier which is present in an analog transmitter in each link, so that the amplitude ratio of the transmission coefficient of each link transmission to the transmission coefficient of the reference link equals to 1, during transmission; and recording and storing the phase difference ψ between each transmitting link and the reference link in the baseband processor.

The method of calibrating a coupling structure with a vector network analyzer in accordance with the present invention, further comprises: setting a pilot antenna in spatial coupling mode; connecting the vector network analyzer to a feeder cable terminal of a pilot signal and antenna unit terminal of the antenna link to be calibrated, connecting an antenna unit terminal of a non-calibrated link to a matched load, measuring and recording the receiving and transmitting transmission coefficient of the link to be calibrated under each necessary working carrier frequency; and repeating the above steps until all receiving and transmitting transmission coefficients of N links have been measured and recorded.

The method of calibrating a coupling structure with a vector network analyzer of the invention further comprises: connecting a passive network coupling structure consisting of N couplers and a 1:N passive distributor/combiner, wherein the N couplers are connected with the antenna terminal of the N antenna units of the smart antenna array, respectively, and the output of the passive distributor/combiner is a feeder cable terminal of the pilot signal; connecting the vector network analyzer to a feeder cable terminal of the pilot signal and antenna unit terminal of the antenna link to be calibrated, connecting the antenna unit terminal of the non-calibrated link with matched load, measuring and recording the receiving transmission coefficient and transmitting transmission coefficient of the link to be calibrated under each necessary working carrier frequency; and repeating the steps above until all receiving transmission coefficient and transmitting transmission coefficients of N links have been measured and recorded.

The invention further includes a device for calibrating smart antenna arrays. The device comprises a calibrated coupling structure, a feeder cable and a pilot transceiver, wherein the coupling structures are coupled on N antenna units of the smart antenna array, the feeder cable is connected with the coupling structure and the pilot transceiver, and the pilot transceiver is connected to a baseband processor in the base station by a digital bus.

The coupling structure is a pilot antenna with spatial coupling mode. The pilot antenna is in the working main lobe of a radiation directivity diagram of the N antenna units, which compose the smart antenna array. The antenna terminal of the pilot antenna is a feeder line terminal of a pilot signal.

When the N antenna units, which compose the smart antenna array, are omni-directional antenna, the pilot antenna is located at any position of a near field region of each antenna unit.

The coupling structure is a passive network, wherein it includes N couplers, corresponding with the N antenna units of the smart antenna array, and a 1:N passive distributor/combiner connected with the N couplers. The N couplers are connected with antenna terminals of the N antenna units, respectively, and the output of the passive distributor/combiner is a feeder line terminal of the pilot signal.

The pilot transceiver has the same structure as the radio frequency transceiver of the base station, including a duplexer, an analog receiver connected with the duplexer, an analog transmitter connected with the duplexer, an analog-to-digital converter connected with the analog receiver and a digital-to-analog converter connected with the analog transmitter. The radio frequency interface of the duplexer is connected with the feeder cable of the coupling structure, and the analog-to-digital converter and digital-to-analog converter are connected to the digital bus.

In the analog receiver, a variable gain amplifier, controlled by software, is set for controlling gain. In the analog transmitter, a variable gain amplifier, controlled by software, is set for controlling gain.

The invention provides a method and device for calibrating smart antenna arrays using the pilot transceiver and a set of coupling structures coupled with smart antenna arrays. The coupling structure includes two technical schemes. One uses a method of calibrating a smart antenna system by a geometrical symmetric structure pilot antenna, located at near field region or far-field region, and an antenna array implementing the method, wherein the pilot antenna and related calibrating software is part of a wireless base station. The other uses a passive network consisting of couplers and distributor/combiner to implement the coupling structure feeds and calibrate the smart antenna array. Either of the two technical schemes allows easy calibration of a base station with smart antenna at all times, and allows changing radio frequency parts and elements at all times. Therefore, the invention can provide a satisfactory solution to the engineering problems associated with smart antenna systems.

The method and device of the invention for calibrating smart antenna arrays are useful in CDMA wireless communication systems. However, with simple changes the proposed method and device can also be used for calibrating smart antenna of FDMA and TDMA wireless communication systems as well.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
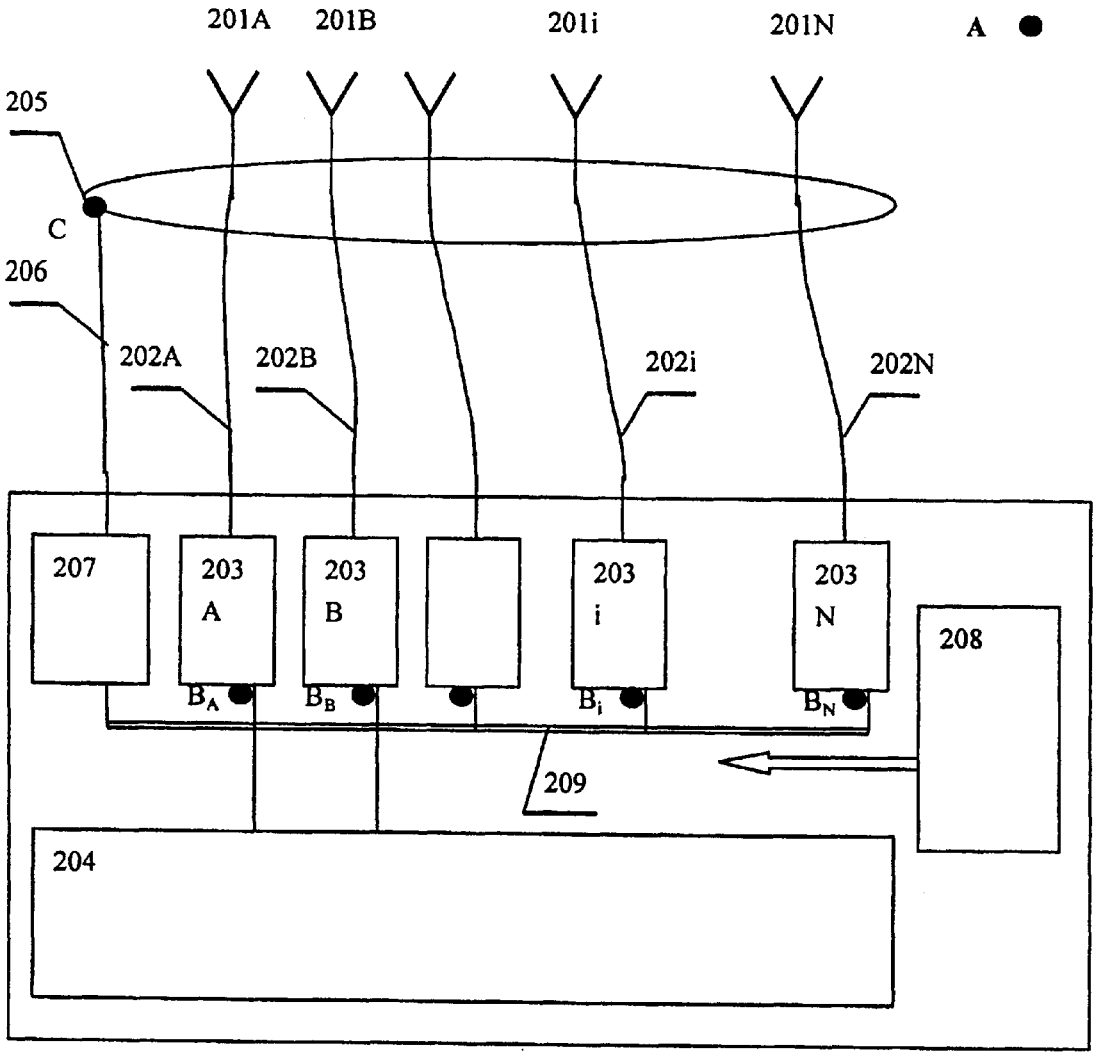
FIG. 1 is a principle diagram of a wireless communication base station using the method and device of the invention.

FIG. 1 illustrates a typical base station structure of a wireless communication system, which uses the method and device of the invention for mobile communication systems or wireless user loop systems, etc., with smart antennas. The base station structure except the calibration part is similar to the base station structure introduced by the Chinese patent named "Time Division Duplex Synchronous Code Division Multiple Access Wireless Communication System with Smart Antenna" (CN 97 1 04039.7). The base station includes N numbers of identical antenna units 201A, 201B, . . . , 201N; N numbers of substantially identical feeder cables 202A, 202B, . . . , 202N; N numbers of radio frequency transceivers 203A, 203B, . . . , 203N and a baseband processor 204. Each radio frequency transceiver 203 includes Analog-to-Digital Converters (ADC) and Digital-to-Analog Converters (DAC), so that all of the input and output baseband signals of all of the radio frequency transceivers are digital signals. The radio frequency receivers are connected to the baseband processor 204 by a high speed digital bus 209. They use the same local oscillator 208 to guarantee that each radio frequency transceiver works in coherence.

In order to implement smart antenna real-time calibration, based on this station structure, the base station further includes a calibration link consisting of a coupling structure 205 (coupling radio frequency circuit), feeder cable 206 and pilot transceiver 207.

Coupling structure 205 is coupled with N feeder cables 202A, 202B, . . . , 202N. Feeder cable 206 connects coupling structure 205 and pilot transceiver 207. Pilot transceiver 207 is connected with high speed digital bus 209, and uses the same local oscillator 208 as all radio frequency transceivers 203.

Figure 2:
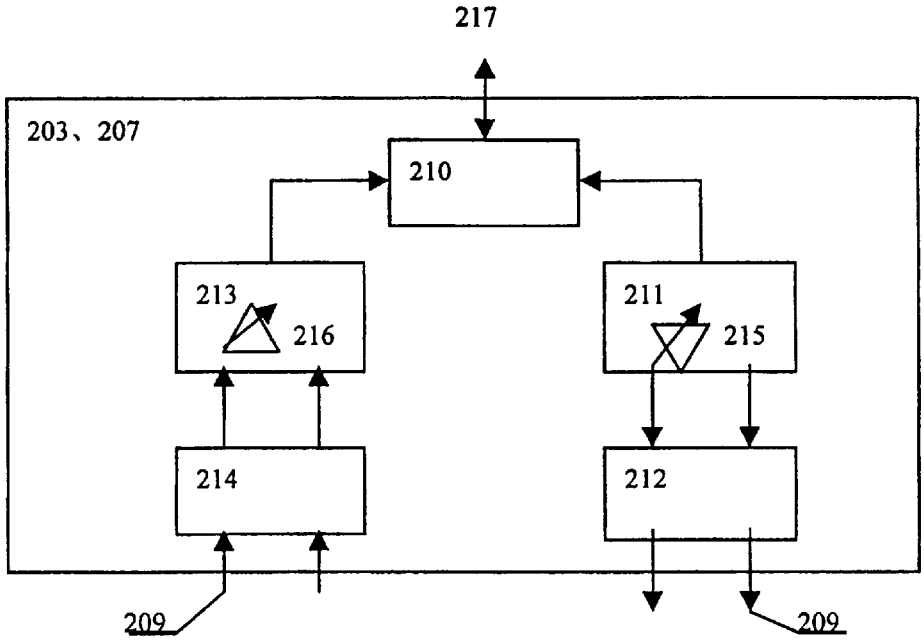
FIG. 2 is a principle diagram of an analog transceiver.

FIG. 2 shows a structure of a radio frequency transceiver 203 or pilot transceiver 207 as shown in FIG. 1. The transceiver includes a duplexer 210, an analog receiver 211, an analog-to-digital converter 212, an analog transmitter 213 and a digital-to-analog converter 214. Analog receiver 211 includes a variable gain amplifier 215 (which can be controlled by software), used to control its gain. Analog transmitter 213 includes a variable gain amplifier 216 (which can be controlled by software), used to control its gain. Radio frequency interface 217 of duplexer 210 is connected to feeder cable 202 and 206 directly. Analog-to-digital converter 212 and digital-to-analog converter 214 are connected with baseband processor 204 through high speed digital bus 209.

In a smart antenna system, which uses a base station structure such as shown in FIG. 1, there are N total transmitting links and receiving links. Any one of them consists of connecting antenna units (201A, 201B, . . . , 201N), feeder cables (202A, 202B, . . . , 202N) and radio frequency transceivers (203A, 203B, . . . , 203N) In addition there is a calibration link consisting of a pilot transceiver 207 and corresponding coupling structure (205 and 206).

Taking the $A^{th}$ link as a reference link (any link can be selected as a reference link), then calibrating the smart antenna system will provide the transmission coefficient amplitude and phase difference between the other links and the reference link on a set working carrier frequency, during receiving and transmitting. Therefore, in the invention, calibration of the smart antenna is a whole system calibration including antenna feeder cables and analog transceivers.

Taking point A at an antenna far-field region in FIG. 1, and $B_i$, which is a baseband interface among $B_A, B_B, \ldots, B_i, \ldots, B_N$ of transceiver 203 in a base station, as an observation reference point, the transmission characteristic of a smart antenna is represented with following formulas:

$$\text{transmission characteristic of receiving link: } Ar_i = Sr_i \times R_i \times br \quad (1)$$

$$\text{transmission characteristic of transmitting link: } Bt_i = St_i \times T_i \times at \quad (2)$$

where i=1, 2, . . . , N represents the first to the $N^{th}$ link, respectively, in formula (1), $Ar_i$ represents the receiving signal of the $i^{th}$ link at point $B_i$ during emission from point A, $Sr_i$ represents degradation of the reception of the $i^{th}$ link by spatial propagation, $R_i$ represents the transmission coefficient of the $i^{th}$ link during reception, and br represents a transmitting signal from point A during reception; in formula (2), $Bt_i$ represents the signal received at receiving point A, coming from the $i^{th}$ link, during emission from point $B_i$, $St_i$ represents degradation of transmission from the $i^{th}$ link by spatial propagation, $T_i$ represents the transmission coefficient during emission from the $i^{th}$ link, and at represents the transmitting signal from point $B_i$ during emission. Both transmitting signals br and at, in the two formulas, respectively, are digital signals, and should remain unchanged during calibration.

Calibration in accordance with the invention obtains, with real-time measure, the difference between the $i^{th}$ link transmission coefficients $R_i$, $T_i$, representing receiving and transmitting, respectively, and the transmission coefficient of the reference link.

The invention is implemented by moving reference point A, noted above, into an antenna array, i.e., output terminal point C of feeder cable 206 in FIG. 1, by providing pilot transceiver 207, related feeder cable 206 and coupling structure 205. Thus formulas (1) and (2) are rewritten respectively:

$$\text{transmission characteristic of receiving link: } ACr_i = Cr_i \times R_i \times br \quad (3)$$

$$\text{transmission characteristic of transmitting link: } BCt_i = Ct_i \times T_i \times at \quad (4)$$

where i=1, 2, . . . , N represents the first to the $N^{th}$ link, respectively. In formula (3), $ACr_i$ represents the receiving signal of the $i^{th}$ link at point $B_i$ during emission from point C, $Cr_i$ represents the transmission coefficient of the coupling structure during a receiving test to the $i^{th}$ link. In formula (4), $BCt_i$ represents the receiving signal from point C, coming from the $i^{th}$ link, during emission from point $B_i$, and $Ct_i$ represents the transmission coefficient of the coupling structure during a transmitting test to the $i^{th}$ link.

If the coupling structure 205 is designed as a passive network, then this coupling structure has interchangeability, i.e.:

$$Cr_i = Ct_i = C_i \quad (5)$$

Replacing formula (5) into formulas (3) and (4) results in the following formulas:

$$\text{Receiving link: } R_i = ACr_i/(C_i \times br) \quad (6)$$

$$\text{Transmitting link: } T_i = BCt_i/(C_i \times at) \quad (7)$$

In the invention, any link can be set as a reference link. As an example, suppose the first link is set as a reference link. Then formulas (6) and (7) are changed to the following formulas:

$$\text{Receiving link: } R_i/R_1 = ACr_i \times C_1/(C_i \times ACr_1) \quad (8)$$

$$\text{Transmitting link: } T_i/T_1 = BCt_i \times C_1/(C_i \times BCt_1) \quad (9)$$

where i=2, 3, . . . , N represents the second to the $N^{th}$ link, all of $ACr_1$, $BCt_1$, $ACr_i$ and $BCt_i$ can be measured in real-time, and $C_1$ and $C_i$ can be calibrated beforehand and are defined by the coupling structure, so $R_i/R_1$ and $T_i/T_1$ needed for smart antenna system calibration can be simply calculated.

Figure 3:
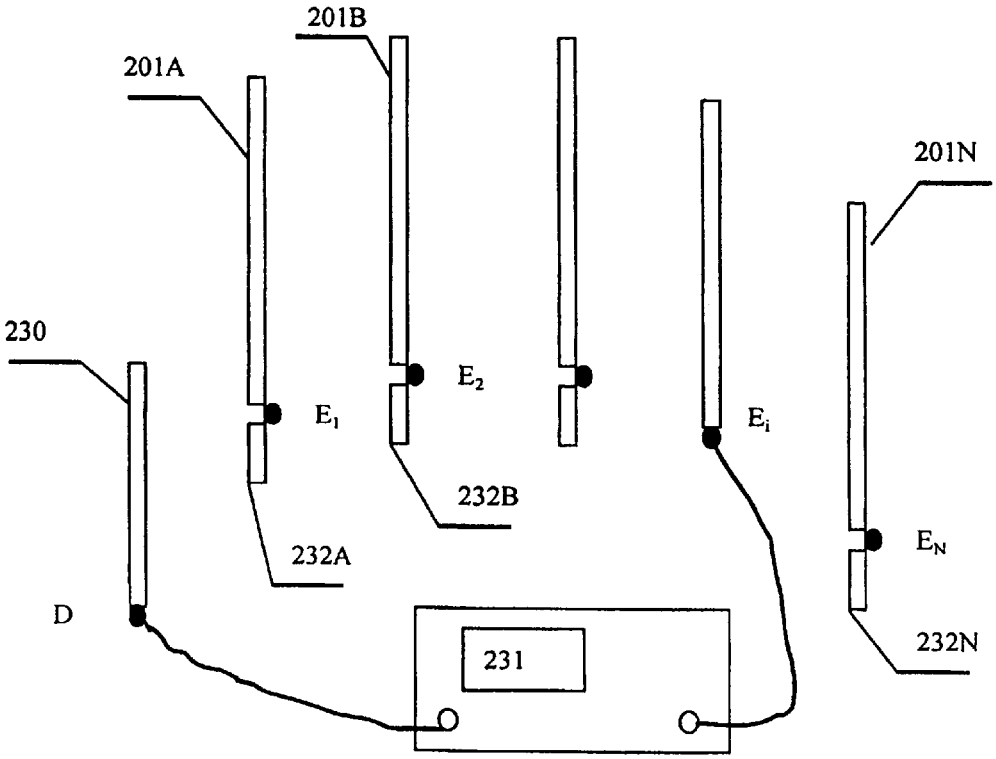
FIG. 3 is a coupling structure diagram using a pilot antenna.

FIG. 3 shows a coupling structure of the invention, i.e., a spatial coupling mode structure applying a pilot antenna 230. Pilot antenna 230 is an antenna, which has a relatively fixed physical position with the antenna array to be calibrated. The pilot antenna 230 must be in the working main lobe of the antenna unit radiation directivity diagram of the antenna array. When each antenna unit is an omni-directional antenna, the pilot antenna can be set at any position including the near field region of the antenna unit.

Applying this coupling structure, the calibration method includes the steps of: connecting a Vector Network Analyzer 231 with a pilot signal feed line terminal D of pilot antenna 230 and antenna terminal $E_i$ of the $i^{th}$ link to be calibrated; at the same time, connecting the other antenna terminals of the antenna array to be calibrated such as $E_1, E_2, \ldots, E_N$ to matched loads 232A, 232B, . . . , 232N, respectively; and then measuring the transmission coefficient $C_i$ of the $i^{th}$ link to be calibrated with the vector network analyzer 231. The transmission coefficients $C_1, \ldots, C_i, \ldots, C_N$ of all links are obtained after doing N times measure.

An advantage of this coupling structure is its simplicity, and when calibrating, inconsistency of every antenna unit has been considered. A disadvantage of this coupling structure is to be limited by the position of the pilot antenna 230. The pilot antenna 230 should be set at a far-field region of the working region of the smart antenna array to be calibrated, in order to guarantee calibration accuracy. Thus the method can be very difficult to implement in practice. Therefore, only when the antenna unit is an omni-directional antenna, the pilot antenna is set at its near field region and its far-field region characteristic is replaced by its near field region characteristic. Then calibration is practical. For example, when using a ring antenna array, the pilot antenna can be set at the center of this ring antenna array, with its geometric symmetry to guarantee reliability of its near field region measure.

Figure 4:
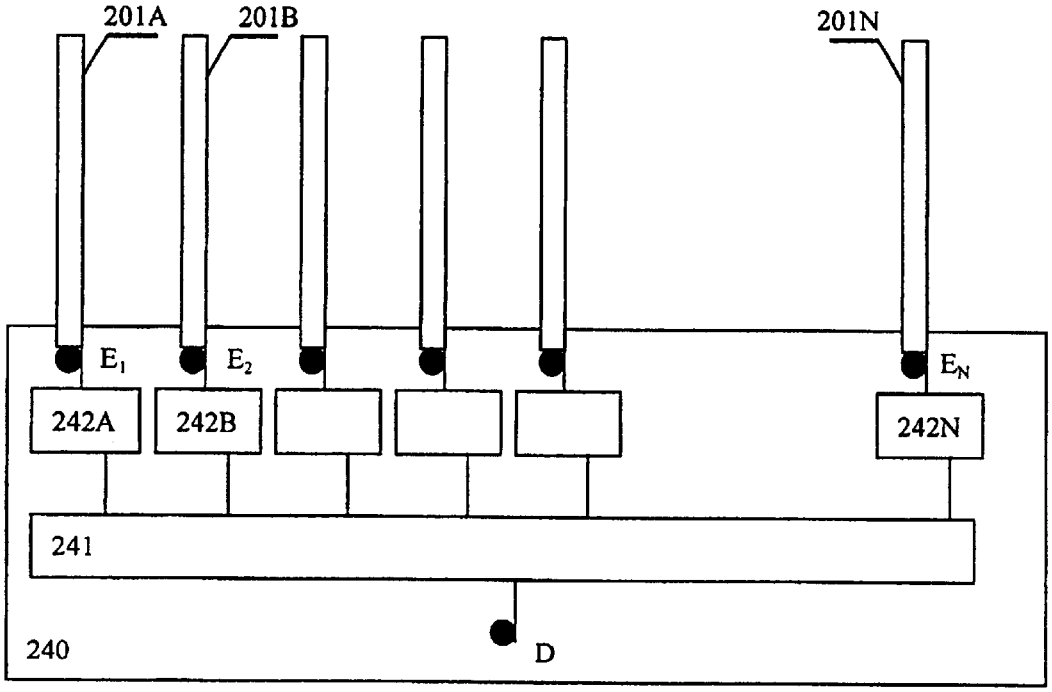
FIG. 4 is a connection diagram of a coupling structure, in a smart antenna array, consisting of a distributor/combiner and a coupler.

FIG. 4 shows a coupling structure of a passive network 240, consisting of a distributor/combiner and a coupler, and its connection with a smart antenna array 201A, 201B, . . . , 201N. The coupling structure includes N couplers 242A, 242B, . . . , 242N corresponding with N antennas 201, and a 1:N passive distributor/combiner 241. Each coupler 242 is located at a connection point $E_1, E_2, \ldots, E_N$ between each antenna unit 201A, 201B, . . . , 201N and its feeder cable 202A, 202B, . . . , 202N. The coupling structure has been independently calibrated before it is mounted in an antenna array.

Figure 5:
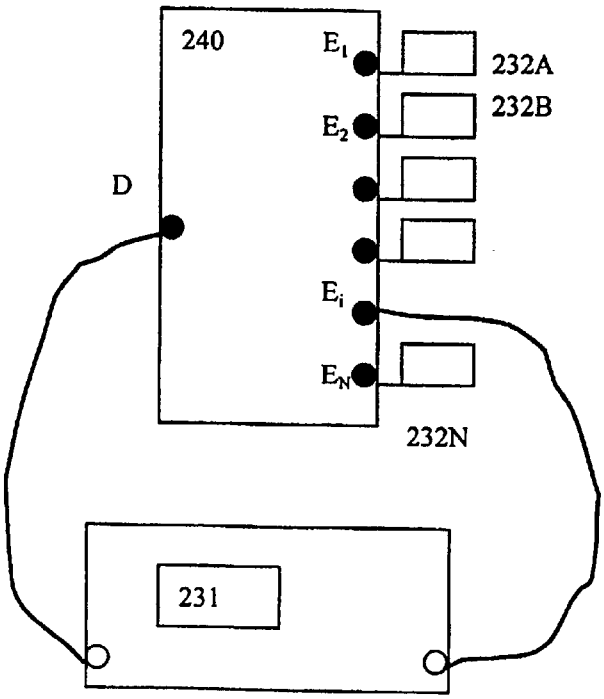
FIG. 5 is another coupling structure of the invention.

Referring to FIG. 5, when applying the coupling structure shown in FIG. 4, the calibration method includes the steps of: connecting a vector network analyzer 231 with a pilot signal feed line terminal D of pilot antenna 230 and antenna terminal $E_i$ of the $i^{th}$ link to be calibrated; at the same time, connecting other antenna terminals of the antenna array to be calibrated such as $E_1, E_2, \ldots, E_N$ to matched loads 232A, 232B, . . . , 232N, respectively; and then measuring the transmission coefficient $C_i$ of the $i^{th}$ link to be calibrated with the vector network analyzer 231. After measuring N numbers, the transmission coefficients $C_1, \ldots, C_i, \ldots, C_N$ of all links are obtained. The calibration method shown in FIG. 5 is the same as the calibration method shown in FIG. 3.

A passive network coupling structure, shown in FIG. 4, is more complex than the pilot antenna coupling structure, shown in FIG. 3. Inconsistency of each antenna unit cannot be considered during calibration, but it can be conveniently used in calibration of any kind of smart antenna array.

Figure 6:
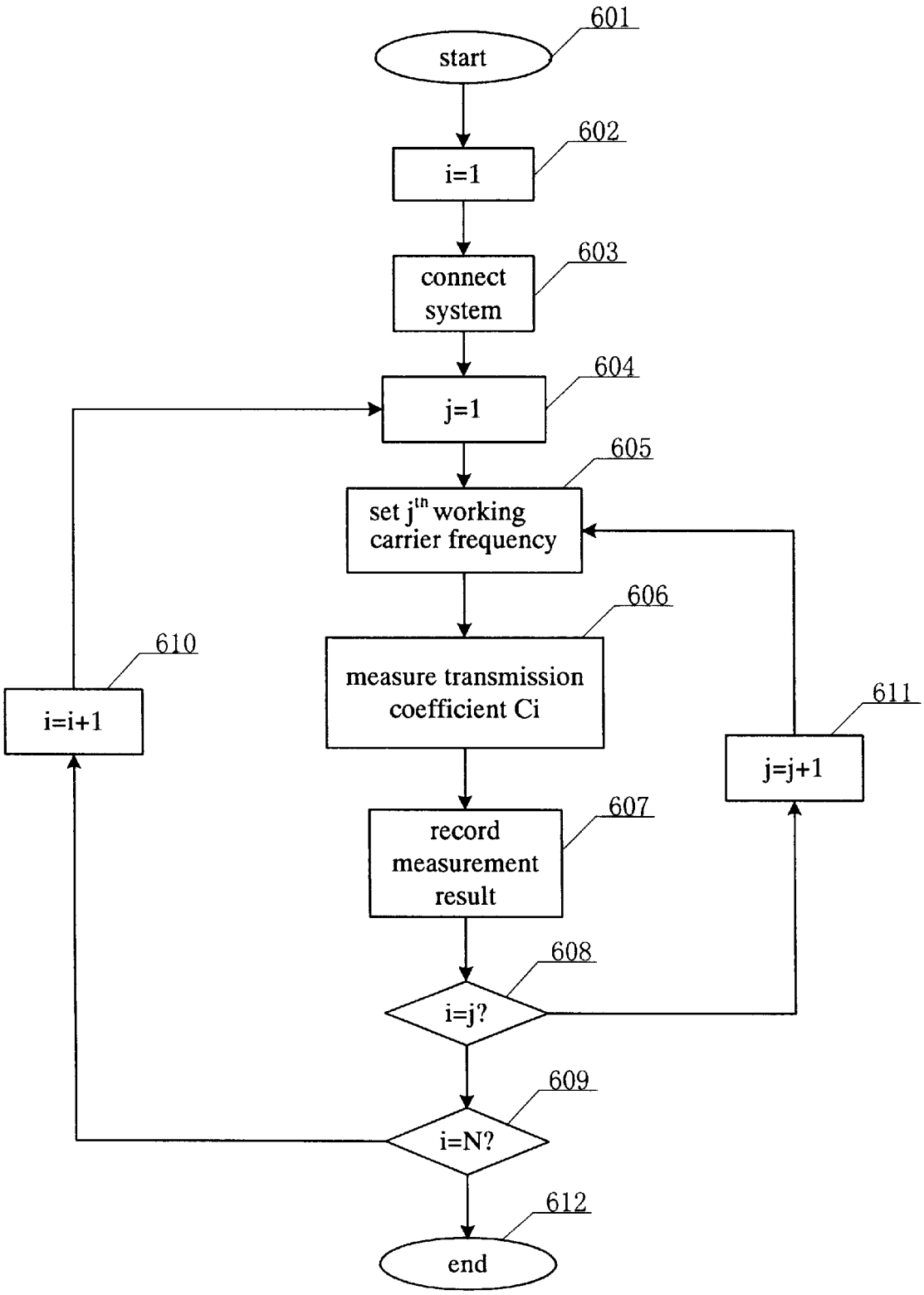
FIG. 6 is flowchart of a coupling structure calibration procedure.

FIG. 6 shows a calibration procedure with a coupling structure. This calibration method can be used for both coupling structures shown in FIG. 3 and FIG. 4. The coupling structure has been calibrated before the smart antenna array is put into operation, and the transmission coefficient C which is obtained is stored in the base station.

Step 601 starts calibration. Step 602 calibrates the first link of N links, i.e., i=1. Step 603 calibrates the first link according to the connection mode shown in FIG. 3 or FIG. 5. Step 604 sets the first calibration frequency equal to the first working carrier frequency of J working carrier frequencies, i.e., j=1. Step 605 sets the first link working carrier frequency equal to the first working carrier frequency. Step 606, with a vector network analyzer, measures the transmission coefficient $C_i$ of the first link when the calibration frequency equals the first working carrier frequency. Step 607 records this measurement result. Steps 608 and 611, by judging i=J? and calculating j=j+1, repeat steps 605 to 608, which measures the first link transmission coefficient at J numbers of working carrier frequency, respectively, and obtains and records the transmission coefficient $C_i$. Steps 609 and 610 repeat measuring said above until measurement of all working carrier frequencies is completed. By judging i=N? and calculating i=i+1, steps 604 to 608 are repeated, which measure transmission coefficients of N links for J numbers of working carrier frequency, and record measuring result.

Each link is measured at each necessary carrier frequency and all measuring results are recorded. The calibration of the coupling structure is then completed and all of the transmission coefficients C are obtained.

Figure 7:
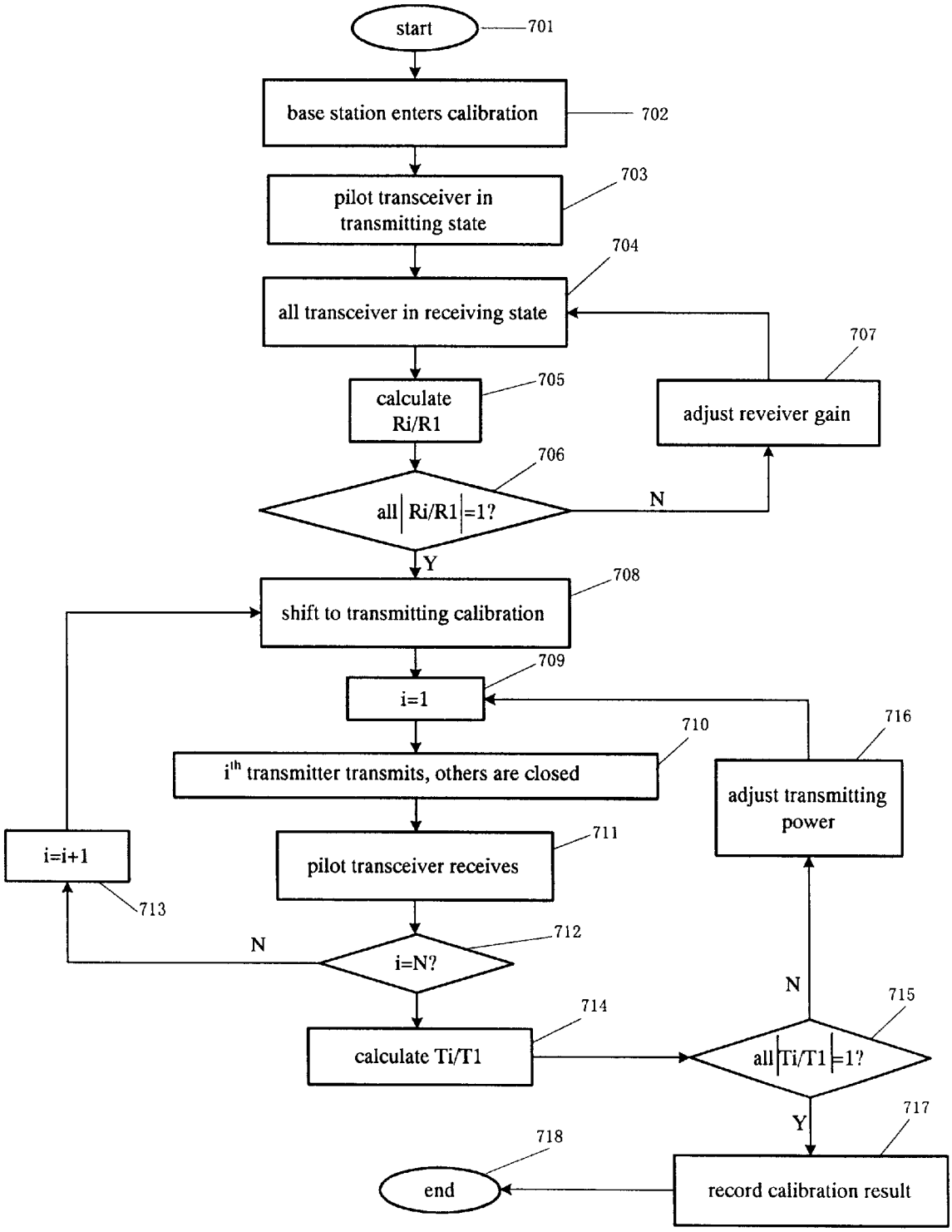
FIG. 7 is flowchart of a smart antenna calibration procedure.

FIG. 7 shows an entire procedure of smart antenna array calibration. Before the smart antenna array is put into operation, its coupling structure has been calibrated according to the procedure shown in FIG. 6, and the receiving and transmitting transmission coefficient C thus obtained has been stored in the base station, where the coupling structure is located.

Step 702 does the receiving calibration first. In step 703, the transmitter of the pilot transceiver transmits a defined voltage level signal with a set working carrier frequency, in order to insure that the receiving system of the base station to be calibrated is working at a normal working voltage level. In step 704, all transceivers in the receiving system of the base station to be calibrated are at a receiving state, i.e., N links are all at receiving state. In step 705, each receiving link output is detected by the baseband processor to make sure that the system is working at a set receiving level and each receiver is working at a linearity region, according to the output of each link receiver and formula (8) baseband processor calculates $R_i/R_1$. In steps 706 and 707, according to calculated $R_i/R_1$, by controlling variable gain amplifier (213 and 216 in FIG. 2) in each receiver, the output of each receiving link is controlled until $|R_i/R_1|=1$. Then the phase difference $\Phi_i$, between each receiving link and reference link is recorded and stored in the baseband processor, which will be used by the smart antenna when working. Step 708, when $|R_i/R_1|=1$, shifts to transmitting calibration. In steps 709 to 715, when calibrating N transmitting links, the receiver of the pilot transceiver receives, respectively, signals coming from each transmitting link at a set working carrier frequency. At this time among N transmitting links, as noted above, only one link is in the transmitting state at one time and all others are in a closing state (step 710). Therefore, in each time, the pilot receiver only receives a signal coming from this link. Currently, the reference transmitting link must be measured and calibrated beforehand in order to make sure that its transmitting power is within a rated voltage level. Under this condition, the receiver of the pilot transceiver receives the signal coming from every transmitting link (step 711). Then the baseband processor processes the measured result and calculates $T_i/T_1$ with formula (9) (step 714). After that, according to this value, the output of each transmitting link is controlled by a variable gain amplifier (211 and 215 in FIG. 2) of each transmitter until $|T_i/T_1|=1$ for each transmitting link (step 716). At the same time, the phase difference $\Psi_i$ between each receiving link and reference link is recorded in the baseband processor, up until the now real-time calibration of the smart antenna is completed.

Although the method and device of the invention are proposed for CDMA wireless communication systems, with simple changes, they can be used in FDMA and TDMA wireless communication systems as well. A base station structure of a wireless communication system, such as shown in FIG. 1, is an example of a TDD wireless communication system. The invention can also be used in FDD wireless communication systems. One skilled in the art of wireless communication systems can implement smart antenna real-time calibration, after understanding basic smart antenna principles and referring to the method and device of the invention.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for calibrating a smart antenna array comprising N receiving and transmitting links, each link comprising an antenna unit and a radio frequency transceiver connected via a feeder cable, the method comprising:

providing a calibration link comprising a coupling structure, a feeder cable and a pilot transceiver, wherein the coupling structure is coupled with N antenna units of the smart antenna array and the pilot transceiver is connected to a baseband processor of a base station by a digital bus;

calibrating the coupling structure before the smart antenna array is put into operation, recording its receiving transmission coefficient and its transmitting transmission coefficient, respectively;

calibrating receiving links: transmitting a defined voltage level calibrating signal at a set working carrier frequency by the pilot transceiver; receiving the signal at the same time by N receiving links of the smart antenna array to be calibrated; choosing a receiving link as a reference link, and equalizing the amplitude of the receiving transmission coefficient of each receiving link of the smart antenna array with the receiving transmission coefficient of the reference link, then calculating the phase difference $\Phi$ between each receiving link and the reference link by using the recorded transmitting transmission coefficient of the coupling structure; and calibrating transmitting links: transmitting a defined voltage level calibrating signal at a set working carrier frequency by only one transmitting link, and setting all other transmitting links in a closing state at the same time; receiving signals coming from each transmitting link by the pilot transceiver, respectively; choosing a transmitting link as a reference link, and equalizing the amplitude of the transmitting transmission coefficient of each transmitting link of the smart antenna array with the transmitting transmission coefficient of the reference link, then calculating the phase difference $\psi$ between each transmitting link and the reference link by using the recorded receiving transmission coefficient of the coupling structure.

2. The method for calibrating a smart antenna array according to claim 1, wherein said coupling structure is calibrated using a vector network analyzer.

3. The method for calibrating a smart antenna array according to claim 2, wherein calibrating the coupling structure with a vector network analyzer comprises:

setting a pilot antenna in spatial coupling mode;

connecting said vector network analyzer to said pilot antenna and to an antenna unit of a link to be calibrated;

connecting an antenna unit of at least another link to a matched load;

measuring and recording the receiving and transmitting transmission coefficient of the link to be calibrated under each necessary working carrier frequency; and repeating each of these steps until the receiving and transmitting transmission coefficients of N links have been measured and recorded.

4. The method for calibrating a smart antenna array according to claim 3, wherein said pilot antenna is located in a working main lobe of a radiation directivity diagram of N antenna units of the smart antenna array and the vector network analyzer is connected to said pilot antenna via an antenna terminal comprising a feeder line terminal of a pilot signal.

5. The method for calibrating a smart antenna array according to claim 3, wherein the antenna units comprising the smart antenna array are omni-directional antenna and the pilot antenna is located at any position of a near field region of each antenna unit.

6. The method for calibrating a smart antenna array according to claim 1, wherein the step of calibrating receiving links of the smart antenna array further comprises:

detecting the output of each receiving link using a baseband processor in the base station and calculating the ratio of the transmission coefficient of each link to the transmission coefficient of the reference link during receiving, according to the output of each receiving link;

controlling the output of each receiving link by controlling a variable gain amplifier located in an analog receiver in each link, so that the amplitude ratio of the transmission coefficient of each link to the transmission coefficient of the reference link during receiving equals 1; and recording and storing the phase difference $\Phi$ between each receiving link and the reference link in the baseband processor.

7. The method for calibrating a smart antenna array according to claim 1, wherein the step of calibrating transmitting links of the smart antenna array further comprises:

processing the signals by the baseband processor of the base station and calculating the ratio of the transmission coefficient of each link to the transmission coefficient of the reference link during transmission;

controlling the output of each transmitting link by controlling a variable gain amplifier located in an analog transmitter in each link, so that the amplitude ratio of the transmission coefficient of each link to the transmission coefficient of the reference link equals 1, during transmitting; and recording and storing the phase difference ψ between each transmitting link and the reference link in the baseband processor.

8. The method for calibrating a smart antenna array according to claim 2, wherein calibrating the coupling structure with a vector network analyzer comprises:

providing a passive network coupling structure consisting of N couplers and a 1:N passive distributor/combiner connected with N couplers, wherein the N couplers are connected with an antenna terminal of the N antenna units of the smart antenna array, respectively, and the output of the passive distributor/combiner is a feeder line terminal of a pilot signal;

connecting the vector network analyzer to the feeder line terminal of the pilot signal and a terminal of the antenna unit of the link to be calibrated;

connecting an antenna unit of at least one other link with a matched load;

measuring and recording the receiving transmission coefficient and transmitting transmission coefficient of the link to be calibrated under each necessary working carrier frequency; and repeating the steps above until all receiving transmission coefficients and transmitting transmission coefficients of the N links have been measured and recorded.

9. A device for calibrating a smart antenna array, comprising:

a calibration link located in near field of the smart antenna array to be calibrated, which comprises a calibrated coupling structure, a feeder cable and a pilot transceiver, wherein the coupling structure is coupled with N antenna units of the smart antenna array, the feeder cable is connected to the coupling structure and the pilot transceiver, and the pilot transceiver is connected to a baseband processor in a base station by a digital bus;

wherein when the calibration link transmits a calibrating signal, N receiving links of the smart antenna array receive the signal at same time; and wherein when each transmitting link of N transmitting links of the smart antenna array transmits a calibrating signal, respectively, the calibration link receives the signal.

10. The device for calibrating a smart antenna array according to claim 9, wherein said coupling structure is a pilot antenna with a spatial coupling mode; the pilot antenna is in the working main lobe of a radiation directivity diagram of the N antenna units of the smart antenna array; and the pilot antenna comprises an antenna terminal comprising a feeder line terminal of a pilot signal.

11. The device for calibrating a smart antenna array according to claim 10, wherein the N antenna units of the smart antenna array are omni-directional antenna, and the pilot antenna is located at any position of a near field region of each antenna unit.

12. The device for calibrating a smart antenna array according to claim 9, wherein said coupling structure is a passive network comprising N couplers, corresponding with the N antenna units of said smart antenna array and a 1:N passive distributor/combiner connected to the N couplers, wherein each of the N couplers is connected to an antenna terminal of the antenna unit, respectively, and the output of the passive distributor/combiner is a feeder line terminal of a pilot signal.

13. The device for calibrating a smart antenna array according to claim 9, wherein said pilot transceiver has the same structure as the radio frequency transceiver of the base station, and includes a duplexer, an analog receiver connected to the duplexer, an analog transmitter connected to the duplexer, an analog-to-digital converter connected to the analog receiver and a digital-to-analog converter connected to the analog transmitter; wherein the duplexer includes a radio frequency interface connected with a feeder cable of the coupling structure, and the analog-to-digital converter and digital-to-analog converter are connected to the digital bus.

14. The device for calibrating a smart antenna array according to claim 13, wherein said analog receiver comprises a variable gain amplifier, controlled by software, which is set for controlling gain; and wherein said analog transmitter comprises a variable gain amplifier, controlled by software, which is set for controlling gain.

* * * * *